US007350334B2

(12) United States Patent
Smith

(10) Patent No.: US 7,350,334 B2
(45) Date of Patent: Apr. 1, 2008

(54) WINDOW REGULATOR ASSEMBLY

(75) Inventor: Peter J. Smith, Ontario (CA)

(73) Assignee: Intier Automotive Closures Inc., Newmarket, Ontario (CA)

( * ) Notice: Subject to any disclaimer, the term of this patent is extended or adjusted under 35 U.S.C. 154(b) by 310 days.

(21) Appl. No.: 10/525,094

(22) PCT Filed: Aug. 20, 2003

(86) PCT No.: PCT/CA03/01239

§ 371 (c)(1),
(2), (4) Date: Feb. 22, 2005

(87) PCT Pub. No.: WO2004/018816

PCT Pub. Date: Mar. 4, 2004

(65) Prior Publication Data

US 2005/0241236 A1 Nov. 3, 2005

(51) Int. Cl.
*E05F 11/48* (2006.01)

(52) U.S. Cl. ..... 49/352; 49/349

(58) Field of Classification Search ..... 49/348, 49/349, 352; 74/413
See application file for complete search history.

(56) References Cited

U.S. PATENT DOCUMENTS 1,651,003 A * 11/1927 Tichenor et al. ..... 74/89.16
4,216,624 A * 8/1980 Blankenburg et al. ..... 49/352
4,421,299 A 12/1983 Hess
4,433,509 A * 2/1984 Seppala ..... 49/352
4,503,732 A * 3/1985 Schust ..... 74/625
4,693,453 A * 9/1987 Ivan ..... 254/323
4,770,056 A * 9/1988 Becker et al. ..... 74/505
5,511,443 A * 4/1996 Munekhoff ..... 74/505
6,949,043 B2 * 9/2005 Rhodes et al. ..... 475/182

FOREIGN PATENT DOCUMENTS

EP 1 143 095 10/2001
WO WO 01/14673 3/2001

* cited by examiner

*Primary Examiner*—Gregory J. Strimbu
(74) *Attorney, Agent, or Firm*—Clark Hill PLC

(57) ABSTRACT

A window regulator assembly including a shaft having a pinion gear and a counter balance spring mounted on the shaft which winds or unwinds as the shaft rotates. A spring housing is mounted on the shaft. A cable-guiding drum having an inner gear is driven directly by the pinion gear. The drum has a rotational axis that is offset from a rotational axis defined by the shaft, thus providing a mechanical advantage. A casing houses spring housing and the drum in an abutting relationship. A guide such as a rail is disposed on at least one of the spring housing and the drum for maintaining rotational alignment of the drum relative to the shaft.

5 Claims, 3 Drawing Sheets

WINDOW REGULATOR ASSEMBLY

FIELD OF INVENTION

The invention relates generally to a window regulator for automotive applications.

BACKGROUND OF INVENTION

An automotive door comprises inner and outer door panels that define a relatively shallow depth therebetween. A window regulator together with its requisite hardware must fit within this constrained space. For example, U.S. Pat. No. 5,987,819 illustrates a representative window regulator. The regulator typically includes a window drive assembly that converts rotational motion from a motor or handheld crank to translate one or more cables that control the opening and closing movement of the window. In order to the limit the size of the regulator, it is helpful to minimize the depth or profile of the drive system, whether the motive source be electrical or mechanical.

PCT Publication No. WO 01/14673 describes a window drive system for automotive applications. This system includes a counter-balance spring that functions to reduce torque requirements when the window is moved upwards. The size of this drive system is minimized by placing the counter balance spring on the shaft of a crown gear that drives a cable-guiding drum.

SUMMARY OF INVENTION

One aspect of the invention provides an improved window regulator assembly that utilizes fewer parts and minimizes the depth or profile of the regulator assembly as compared to the known prior art. Generally speaking, the drum of the window regulator assembly is directly driven in order to minimize the stack height or profile of the assembly.

According to this aspect of the invention, a window regulator assembly is provided which includes a shaft having a pinion gear and a counter balance spring mounted on the shaft and disposed to wind or unwind when the shaft rotates. A spring housing is mounted on the shaft for covering the spring. A drum having an inner gear is in meshing engagement with the pinion gear. The drum has cable guides on its exterior periphery for guiding at least one cable wound therearound. A casing houses the spring, the spring housing and the drum in abutting relationship. Means, such as a guide disposed on at least one of the spring housing and the drum, is provided for maintaining rotational alignment of the drum relative to the shaft. Preferably, the drum has a rotational axis that is offset from a rotational axis defined by the shaft, thus providing mechanical advantage.

DESCRIPTION OF THE DRAWINGS

In drawings that illustrate embodiments of the invention.

DESCRIPTION OF THE INVENTION

Figure 1:
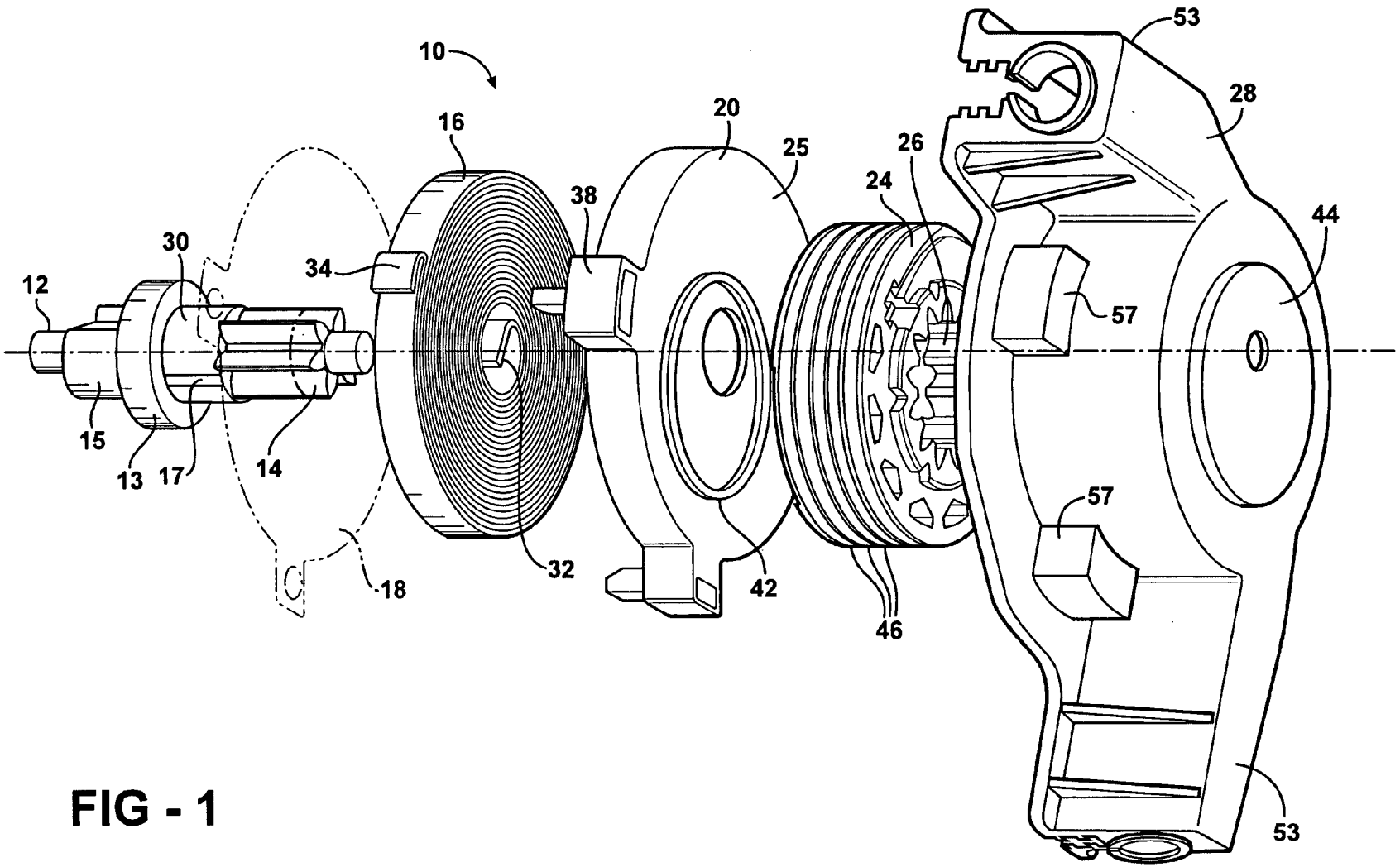
FIG. 1 is an exploded perspective view of the window regulator assembly according to the preferred embodiment.

FIG. 1 illustrates the window regulator assembly 10 of the present invention. The major components of the assembly 10 include:

- a drive shaft 12 having an integrated pinion gear 14;
- a counter balance spring 16;
- a counter balance spring cover disc 18;
- a spring housing 20;
- a cable drum 24 having an inner circumferential gear face 26; and
- a drive housing or casing 28.

The drive shaft 12 has a central shaft including a flange 13. A lost motion connection 15 is on one side of the flange 13 and a bearing surface 30 and pinion gear 14 are located on the opposite side. Preferably, drive shaft 12 is made of machined steel.

The counter balance spring 16 is a conventional counter balance spring made of flat spring steel stock. The counter balance spring 16 extends between the drive shaft 12 and the spring housing 20 to provide a counter balancing force on drive shaft 12 to minimize winding efforts required to open and close a window. Counter balance spring 16 is wound about bearing surface 30 of the drive shaft 12. The inner end of spring 16 has a hook 32 that engages an axially aligned receiving slot 17 on drive shaft 12. The spring 16 is wound up a few turns to provide a pre-tension. The pre-tension tightens the first few inner coils around the drive shaft 12, thereby holding the spring hook 32 in place.

Figure 2:
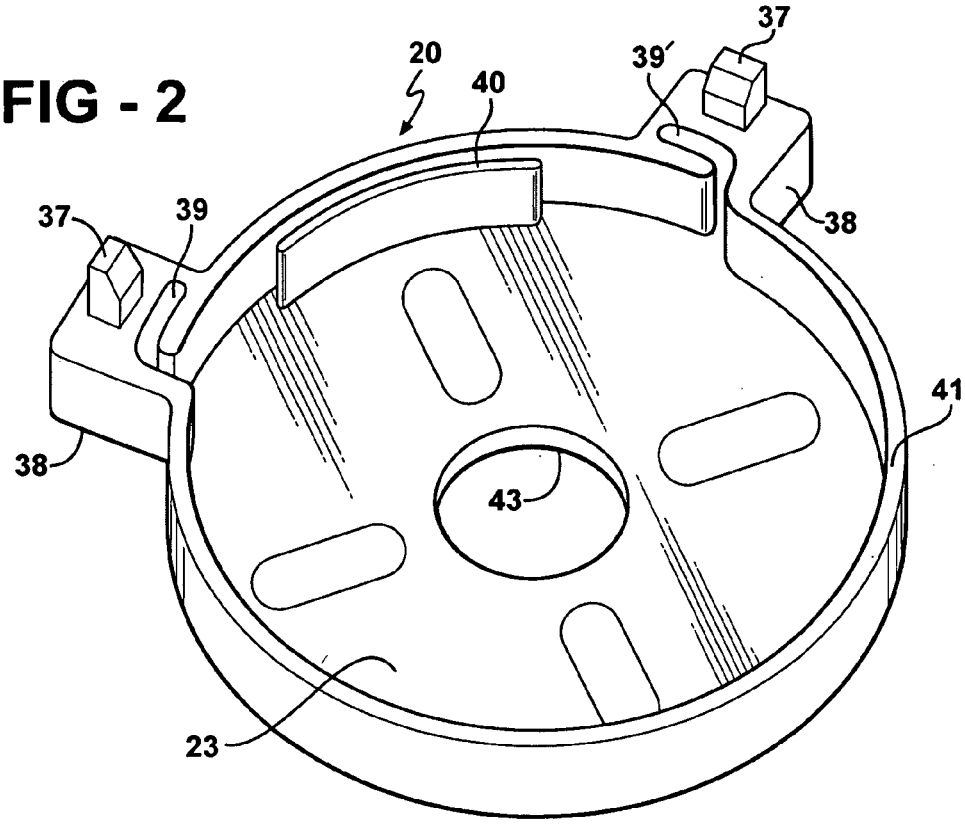
FIG. 2 is a perspective view of a spring housing of the assembly shown in FIG. 1.

The spring housing 20 is generally cup shaped having an axial thickness of about the thickness of the spring 16. The housing 20 has a pair of tabs 38 extending radially from an outer wall 41. Preferably, the tabs 38 are located approximately 90° relative to each other. As seen best in FIG. 2, each tab 38 has a hooked slot 39, 39', being left and right handed slots. Each tab 38 also has a tang 37 that is available for final assembly of the regulator.

An inner face 23 of spring housing 20 has an outer coil guide ring 40. The guide 40 is arcuate and extends between the two tabs 38. The guide 40 is spaced from the wall 41 of the housing approximately equivalent to the radial thickness of the spring 16. The outermost coil of spring 16 is inserted between guide 40 and wall 41, while the outer end of spring 16 has a hooked end 34 that is inserted into one of slots 39, 39'. This installation prevents bias of the spring 16 in the housing 20 during wind-up. This reduces hysteresis and produces a much smoother torque curve.

The spring 16 functions to achieve similar operating torques when the window is moved in either direction, up or down. Ideally, the spring slope should be relatively shallow in order to avoid large differences between the torque assist and full down and full up positions.

Spring housing 20 has a central aperture 43 through which drive shaft 12 extends and defines a drive axis. As shown in FIG. 1, an outer surface 25 of the spring housing 20 preferably includes a ring 42 that is offset from the drive axis.

Figure 3A:
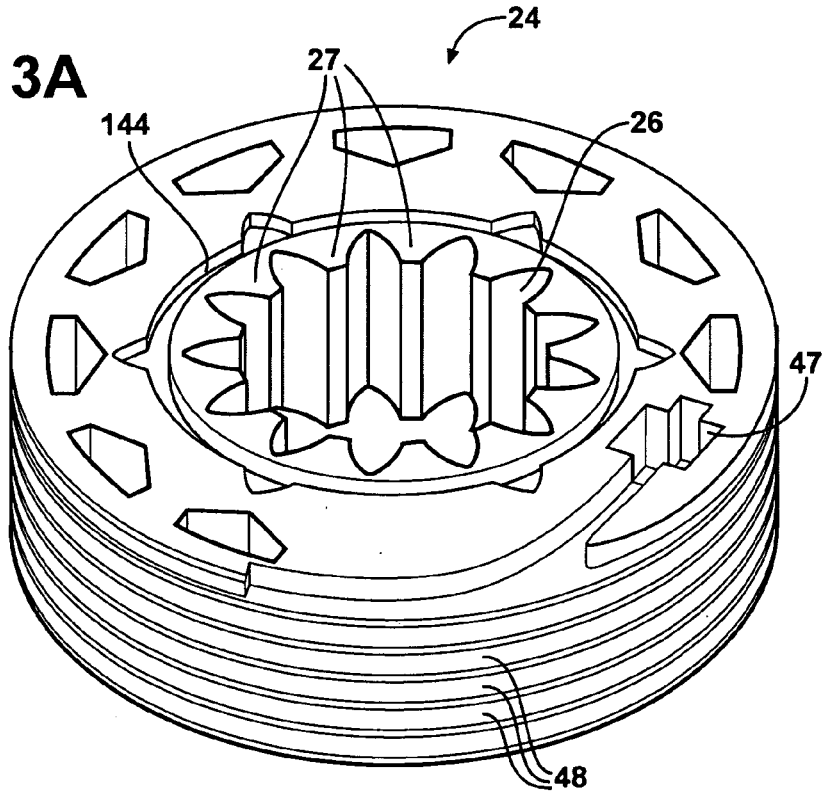
FIG. 3*a* is a perspective view of a first side of a cable drum of the assembly shown in FIG. 1.
Figure 3B:
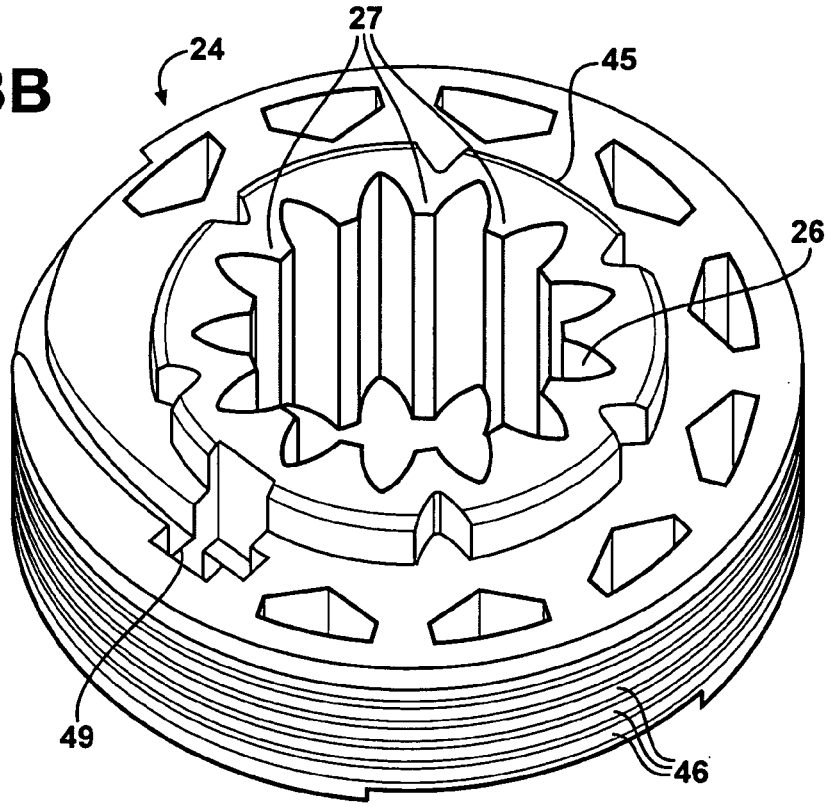
FIG. 3*b* is a perspective view of a second side of the cable drum of the assembly shown in FIG. 1.

The drum 24, which is also shown in isolation in FIG. 3A, includes a circular groove 144 that mates with the circular ring 42 to maintain the offset alignment and defines a drum axis offset from the drive axis. The drum 24 has a central bore 26 having a series of internal teeth 27. The outer drum surface has a helical groove 46 that communicates with terminal pockets 47, 49 on opposite axial end faces of the drum 24. The terminal pockets 47, 49 receive drive cable end fittings in a manner well known in the art.

The drum 24 has a raised embossment 45 on the face opposite the groove 144. Referring back to FIG. 1, the drive casing 28 is configured to receive the drum 24 and spring housing 20. The casing 28 has a circular recess 44 that receives embossment 45 of the drum 24 in a sliding relation. Recesses 51 receive tabs 38. The casing 28 has two cable outlets 53 from which the cables extend.

Figure 4:
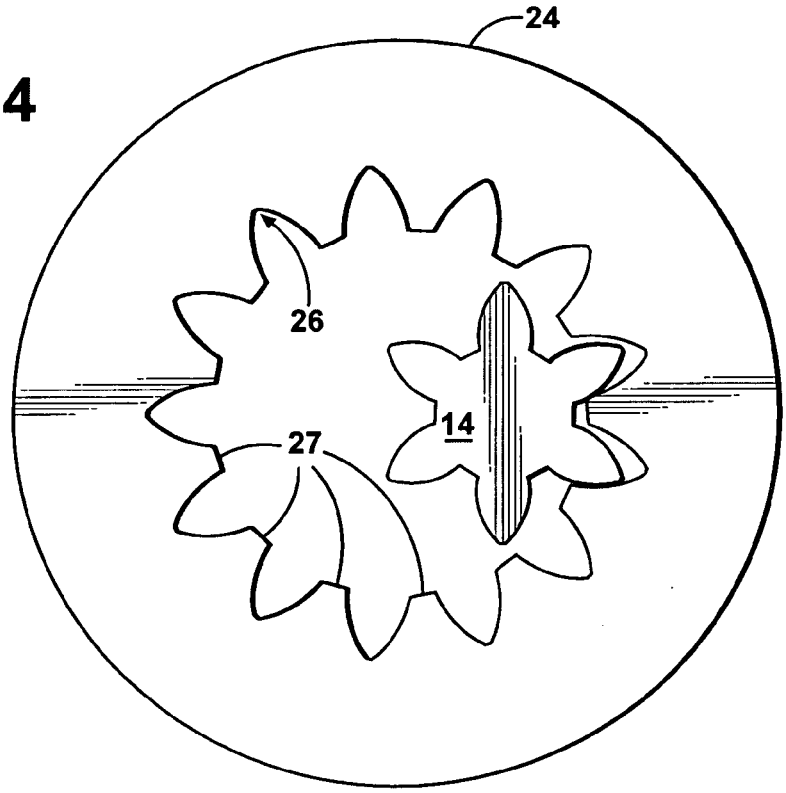
FIG. 4 is a plan view of the gear engagement of the assembly shown in FIG. 1.

Once assembled, the drive pinion 14 drivingly engages with the internal teeth 27 of the central bore 26. As shown schematically in FIG. 4, the pinion gear 14 is relatively small, preferably comprising a six-tooth involute gear, that mates with a thirteen-tooth internal gear formed by the internal teeth 27 of the central bore 26 of the drum 24. This arrangement, made possible by the aforementioned offset alignment, provides a gear reduction system (2.17:1 in the preferred embodiment). It is understood that the present invention is not limited to this specific gear reduction and it will be appreciated by those skilled in the art that other gear ratios may be utilized within the scope of the present invention. It will also be appreciated that the axial offset between the drum 24 and shaft 12 can be provided by other types of guiding mechanisms. For example, the drum 24 could have a circular rail and the spring housing 20 could have a corresponding groove. Alternatively, the casing 28 could be modified to contain the drum 24 circumferentially instead of axially (or in addition thereto) in order to maintain the offset alignment.

The present system uses fewer parts than the system disclosed in PCT Publication No. WO 01/14673, thus enabling a shallower depth profile. The present system also reduces motive torque requirements as compared to the prior art.

The above-described embodiment of the invention is intended to be an example of the present invention and alterations and modifications may be effected thereto, by those of skill in the art, without departing from the spirit of the invention.

What is claimed is:

1. A window regulator assembly, comprising:

a shaft having a pinion gear;

a counter balance spring mounted on said shaft and disposed to wind or unwind when said shaft rotates;

a spring housing mounted on said shaft for covering said spring, said spring housing including an outer surface;

a drum having a central bore with a series of internal teeth in driving and meshing engagement with said pinion gear, said drum having cable guides on its exterior periphery for guiding at least one cable wound therearound, said drum including a first axial end face in facing relationship to said outer surface of said spring housing, a rotational axis of said drum being offset with respect to a rotational axis of said pinion gear;

a casing for housing said spring, said spring housing and said drum, wherein said casing houses said spring housing and said drum in an abutting relationship with one another; and a rail formed on one of said outer surface of said spring housing and said first axial end face of said drum, said rail extending around said central bore, and a corresponding groove formed in the other of said outer surface of said spring housing and said first axial end face of said drum, said groove disposed radially outward of said central bore and receiving said rail therein for maintaining rotational alignment of said drum relative to said shaft.

2. An assembly according to claim 1, further including an embossment formed on a second axial end face of said drum opposite said first axial end face and a recess formed in said casing receiving said embossment therein.

3. An assembly according to claim 1, wherein said spring housing is constrained from rotating by said casing, said spring having an inner end thereof fixed to said shaft and an outer end thereof fixed to said spring housing.

4. An assembly according to claim 3, wherein said spring housing includes at least one tab and said casing includes a recess in which said tab is seated.

5. An assembly according to claim 1, wherein said rail extends in a circular path and said groove extends in a corresponding circular path.

* * * * *